US011199299B2

(12) United States Patent
Plavnicky

(10) Patent No.: US 11,199,299 B2
(45) Date of Patent: Dec. 14, 2021

(54) LED LIGHTING SYSTEM AND METHODS

(71) Applicant: REVEL GEAR, LLC, Boulder, CO (US)

(72) Inventor: Brian Christopher Plavnicky, Boulder, CO (US)

(73) Assignee: REVEL GEAR, LLC, Boulder, CO (US)

( * ) Notice: Subject to any disclaimer, the term of this patent is extended or adjusted under 35 U.S.C. 154(b) by 0 days.

(21) Appl. No.: 16/882,250

(22) Filed: May 22, 2020

(65) Prior Publication Data

US 2020/0393096 A1 Dec. 17, 2020

Related U.S. Application Data

(63) Continuation of application No. 16/125,581, filed on Sep. 7, 2018, now Pat. No. 10,663,123.

(60) Provisional application No. 62/555,228, filed on Sep. 7, 2017.

(51) Int. Cl.

| | |
|---|---|
| ***F21S 4/26*** | (2016.01) |
| ***F21V 23/00*** | (2015.01) |
| ***F21V 23/06*** | (2006.01) |
| ***F21V 19/00*** | (2006.01) |
| ***F21V 3/06*** | (2018.01) |

(Continued)

(52) U.S. Cl.

CPC ..... *F21S 4/26* (2016.01); *F21V 3/062* (2018.02); *F21V 19/0025* (2013.01); *F21V 23/001* (2013.01); *F21V 23/06* (2013.01); *F21Y 2103/10* (2016.08); *F21Y 2115/10* (2016.08)

(58) Field of Classification Search

CPC ..... F21S 4/26; F21V 3/062; F21V 19/0025; F21V 23/001; F21V 23/06

See application file for complete search history.

(56) References Cited

U.S. PATENT DOCUMENTS

2001/0053079 A1‡ 12/2001 Demaria ..... F21V 9/08 362/249.02
2002/0126473 A1‡ 9/2002 Conti ..... F21V 9/30 362/84

(Continued)

FOREIGN PATENT DOCUMENTS

CN 202195331 U ‡ 4/2012
CN 202195331 U 4/2012

(Continued)

*Primary Examiner* — Anne M Hines
(74) *Attorney, Agent, or Firm* — Holland & Hart LLP

(57) ABSTRACT

An LED lighting system includes first, second and third conductive wires, a plurality of light emitting diodes (LEDs), a transparent insulated layer, and a universal serial bus (USB) plug. The first conductive wire is configured to carry a positive charge. The second conductive wire is configured to carry a negative charge. The third conductive wire is configured to carry a ground charge. The first, second and third conductive wires are arranged side-by-side. The plurality of LEDs are mounted to each of the first, second and third conductive wires. The transparent insulated layer extends around and encapsulates the first, second and third conductive wires and the plurality of LEDs. The USB plug is electrically connected to the first, second and third conductive wires.

18 Claims, 8 Drawing Sheets

(51) Int. Cl.
*F21Y 103/10* (2016.01)
*F21Y 115/10* (2016.01)

(56) References Cited

U.S. PATENT DOCUMENTS

| | | | | |
|---|---|---|---|---|
| 2005/0207170 | A1* | 9/2005 | Opolka | B60Q 3/59 362/391 |
| 2009/0154156 | A1* | 6/2009 | Lo | F21V 5/002 362/234 |
| 2012/0281398 | A1‡ | 11/2012 | King | F21S 4/10 362/23 |
| 2013/0009191 | A1‡ | 1/2013 | Wang | H01L 33/62 257/99 |
| 2013/0242560 | A1‡ | 9/2013 | Hsu | F21V 19/001 362/24 |

FOREIGN PATENT DOCUMENTS

| | | | | | |
|---|---|---|---|---|---|
| CN | 202511095 | U | ‡ | 10/2012 | |
| CN | 202511095 | U | | 10/2012 | |
| CN | 203656688 | U | ‡ | 6/2014 | |
| CN | 203656688 | U | | 6/2014 | |
| CN | 204026296 | U | ‡ | 12/2014 | F21S 4/10 |
| CN | 204026296 | U | | 12/2014 | |
| CN | 104295975 | A | ‡ | 1/2015 | |
| CN | 104295975 | A | | 1/2015 | |
| CN | 104344243 | A | ‡ | 2/2015 | |
| CN | 104344243 | A | | 2/2015 | |
| WO | 2014166202 | A1 | | 10/2014 | |
| WO | WO-2014166202 | A1 | ‡ | 10/2014 | H05B 45/40 |

* cited by examiner
‡ imported from a related application

LED LIGHTING SYSTEM AND METHODS

RELATED APPLICATIONS

This application is a continuation of U.S. patent application Ser. No. 16/125,581, filed 7 Sep. 2018 and titled "LED Lighting System and Methods," which claims priority to U.S. Provisional Patent Application No. 62/555,228, filed on 7 Sep. 2017 and titled "An Insulated or Protected USB Powered LED Light Made of Wires and Surface Mounted LEDs," which applications are incorporated herein in their entireties by this reference.

TECHNICAL FIELD

The present disclosure relates generally to lighting systems, and more particularly relates to light emitting diode (LED) lighting systems and insulative and/or protective coatings for such lighting systems.

BACKGROUND

Creating durable, functional wiring systems and cables poses a number of challenges. Typically, repeatedly bending a wire results in failure of the wire (e.g., breaking of the wire of inability of the wire to efficiently transmit signals or power). If there is a power being transmitted through the wire and the wire becomes damaged, the flow of electricity will stop and the wire becomes ineffective for its intended purpose. Another challenge associated with wiring systems and cables is proper management of the wires themselves. For example, multiple wires/cable extending in parallel with each other can easily become entangled with each other or other objects. This is true particularly for wires/cables of significant length (e.g., 5 feet, 10 feet or greater). Tangled wires/cables are difficult to handle, align in a straight arrangement, and more easily break or become damaged.

Some lighting systems include light fixtures (i.e., a device that generates light) mounted directly to the wire or cable that provides power to the light fixture. Wiring/cables that include light fixtures may be even more challenging to manage and protect from damage. Further, in some applications it is advantageous to protect the light fixtures, particularly when it is anticipated that the light fixtures will be exposed to harsh environmental conditions. Challenges exist related to protecting the light fixtures without negatively impacting the dissemination of light generated by the light fixtures.

Opportunities exist for wiring and cable management and protection of light fixtures, and particularly for lighting applications.

SUMMARY

One aspect of the present disclosure relates to a lighting system, such as an LED lighting system. The lighting system includes a plurality of conductive wires arranged side-by-side, a plurality of light emitting diodes (LEDs) mounted and electrically connected to the plurality of conductive wires, a braided layer, and a universal serial bus (USB) plug. The braided layer is positioned around the plurality of conductive wires and includes a plurality of strands of material braided together. The braided layer provides at least one of an insulating property, a wire containment property, and a wear resistant property for the lighting system. The USB plug is electrically connected to the plurality of conductive wires.

The braided layer may extend between adjacent LEDs. A first of the plurality of conductive wires may be configured to carry a positive charge, and a second of the plurality of conductive wires may be configured to carry a negative charge. The plurality of conductive wires may include three conductive wires.

Another aspect of the present disclosure relates to an LED lighting system that includes first, second and third conductive wires, a plurality of light emitting diodes (LEDs), a transparent insulated layer, and a universal serial bus (USB) plug. The first conductive wire is configured to carry a positive charge. The second conductive wire is configured to carry a negative charge. The third conductive wire is configured to carry a ground charge. The first, second and third conductive wires are arranged side-by-side. The plurality of LEDs are mounted to each of the first, second and third conductive wires. The transparent insulated layer extends around and encapsulates the first, second and third conductive wires and the plurality of LEDs. The USB plug is electrically connected to the first, second and third conductive wires.

The transparent insulated layer may include a plurality of strands of transparent plastic braided around the at least first, second and third conductive wires and the plurality of LEDs. The lighting system may have a length in the range of 5 ft to 10 ft. The transparent insulted layer may include polymer material. The transparent insulted layer may include an ultraviolet (UV) light resistant material.

Another aspect of the present disclosure relates to a method of manufacturing a lighting system. The method includes providing at least first and second conductive wires, a plurality of light emitting diodes (LEDs), a transparent insulated material, and a universal serial bus (USB) plug, arranging the at least first and second conductive wires side-by-side, electrically connecting the plurality of LEDs to the at least first and second conductive wires, forming a protective layer around the at least first and second conductive wires and the plurality of LEDs from the transparent insulated material, and electrically connecting the USB plug to the at least first and second conductive wires.

The method may further include arranging an insulative material between the at least first and second conductive wires. The transparent insulated material may include a plurality of strands of plastic material, and forming the protective layer may include braiding the plurality of strands of plastic material. Forming the protective layer may include extruding the transparent insulated material around the at least first and second conductive wires and the plurality of LEDs from the transparent insulted material. Electrically connecting the plurality of LEDs and USB plug to the at least first and second conductive wires may include soldering the plurality of LEDs and the UBS plug to each of the at least first and second conductive wires. Forming the protective layer may include encapsulating the at least first and second conductive wires and the plurality of LEDs with the transparent insulated material.

BRIEF DESCRIPTION OF THE DRAWINGS

The accompanying drawings and figures illustrate a number of exemplary embodiments and are part of the specification. Together with the present description, these drawings demonstrate and explain various principles of this disclosure. A further understanding of the nature and advantages of the present invention may be realized by reference to the following drawings. In the appended figures, similar components or features may have the same reference label.

Figure 1:
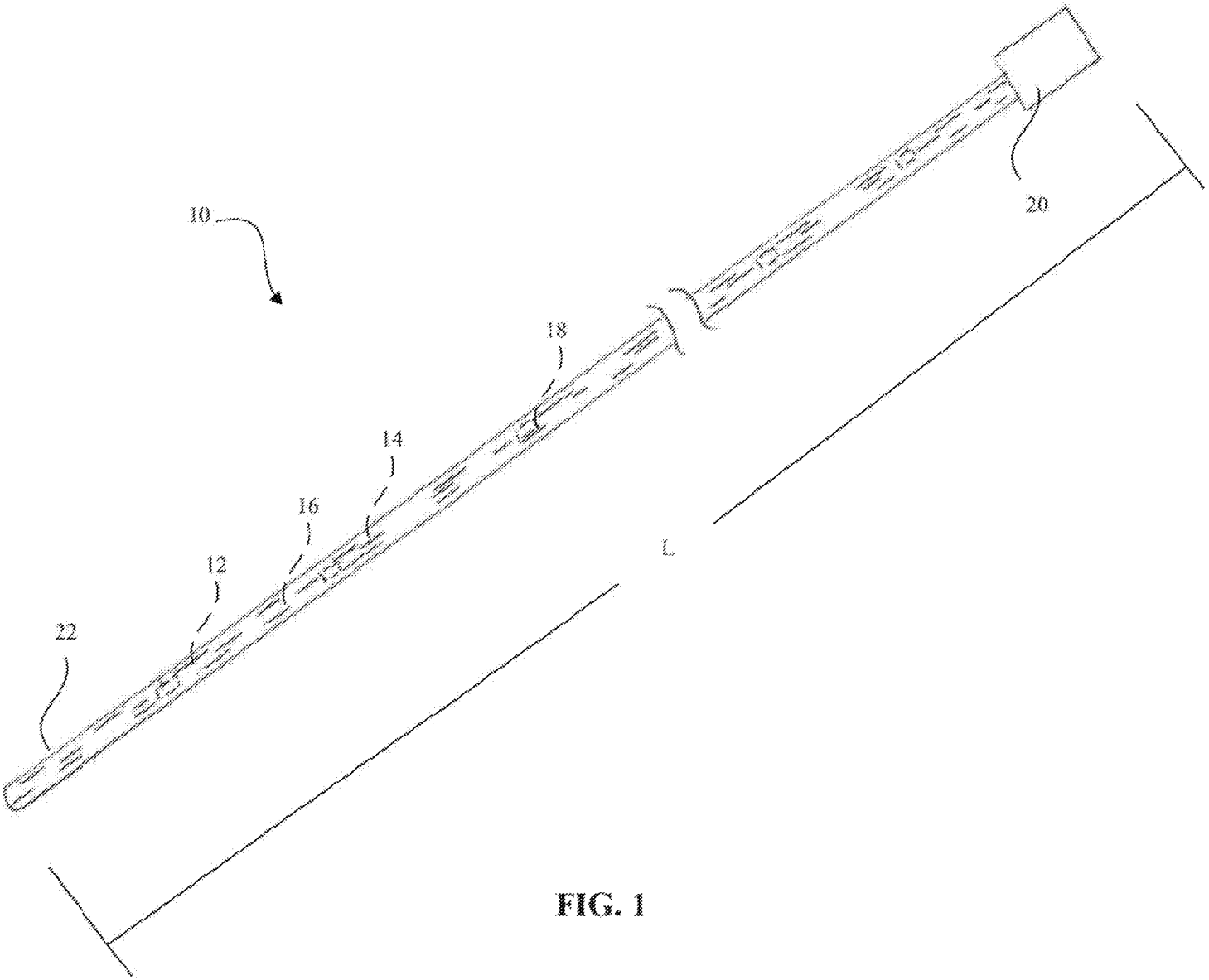
FIG. 1 is a perspective view of an example lighting system in accordance with the present disclosure.

While the embodiments described herein are susceptible to various modifications and alternative forms, specific embodiments have been shown by way of example in the drawings and will be described in detail herein. However, the exemplary embodiments described herein are not intended to be limited to the particular forms disclosed. Rather, the instant disclosure covers all modifications, equivalents, and alternatives falling within the scope of the appended claims.

DETAILED DESCRIPTION

The present disclosure relates to lighting systems, and particularly to lighting systems that includes a plurality of wires and/or cables, and light fixtures electrically connected to the wiring/cables. The wiring and light fixtures can be enclosed within a protective and/or insulated layer, which can assist with managing the wiring and light fixtures and protecting them from damage. Cover the light fixtures with a transparent material minimizes the reduction in overall light output from the lighting system while still providing the advantages associated with managing, insulating and protecting the wiring and light fixtures.

FIGS. 1-10 illustrate aspects of various lighting systems in accordance with the present disclosure. The lighting systems may be referred to as lighting remitting diode (LED) lighting systems. The lighting systems may also be referred to as low-voltage lighting systems. The lighting systems include features that provide improved strength, durability, insulative properties, wire management, and/or other features and functionality as compared to existing products.

Referring to FIG. 1, an example LED lighting system 10 is shown including a fire wire 12, a second wire 14, a third wire 16, a plurality of LEDs 18, a connector 20, and an insulated layer 22. The LEDs 18 are electrically connected to the first, second and/or third wires 12, 14, 16. The LEDs may include an LED package that includes at least one light admitting diode (LED), a plurality of wire connection features, a printed circuit board, and other electronic components. The first, second and third wires 12, 14, 16 may provide power to LEDs 18. The first, second and third wires 12, 14, 16 may also provide control signals for controlling operation of the LEDs (e.g., a lighting sequence, a timed off-on control, etc.). The first, second and third wires 12, 14, 16 are electrically connected to the connector 20. In some embodiments, the first, second and third wires 12, 14, 16 and the LEDs 18 are positioned internal the insulated layer 22. In other embodiments, one or more of the LEDs 18 may be exposed outside of the insulated layer 22. An example LED 18 is a 0603 LED, or an 0805 LED The first, second and third wires 12, 14, 16 may comprise a conducted material. The conducted material may include, for example, copper or other metal material. In other examples, non-metal, conductive material may be used for one or more of the first, second and third wires 12, 14, 16. Typically, the first, second and third wires 12, 14, 16 extend along the entire length L of the LED lighting system 10. In other embodiments, one or more of the first, second and third wires 12, 14, 16 may extend along only a portion of the length L, such as only to a position of the LED 18 that is located furthest from the connector 20. In other embodiments, the wires 12, 14, 16 may switch current and/or polarity, or share current and/or polarity.

The first, second and third wires 12, 14, 16 may be individually insulated so as to eliminate electrical shorting between the wires 12, 14, 16. In one example, the wires 12, 14, 16 are covered with an enamel layer, or at least two of the wires 12, 14, 16 are covered with an enamel or other insulating material. In another example, the wires 12, 14, 16 are provided as stranded copper wires in which each copper wire is covered with an enamel or other insulating material. There can be any number of wires in this stranded copper wire that are twisted together, and the twisted strand is insulated. In a still further example, the wires 12, 14, 16 are provided as stranded wires that are twisted with one or more nylon fibers or other fiber or filament like silk, Kevlar, etc. Each of the copper strands in the stranded wire can be insulated with enamel or other insulator material. The number of copper (or other conductive material) strands may be 7, 10, 20 or any number of individual wires in the twisted strand. The nylon fibers may provide increased flexibility, durability, strength and/or other properties that may be advantageous. The wire strands in the bundle twisted strands may be individually insulated such as with an enamel layer. In some embodiments, the entire twisted bundle of wires with, for example, the nylon strand, is insulated as a bundle. In all of the examples described herein, at least the first and second wires 12, 14 may be exposed at certain locations along its length for electrical connection to one or more of the LEDs 18. In some embodiments, the LEDs include connectors that pierce through insulated material into contact with the conductive material of the wires 12, 14.

Figure 2:
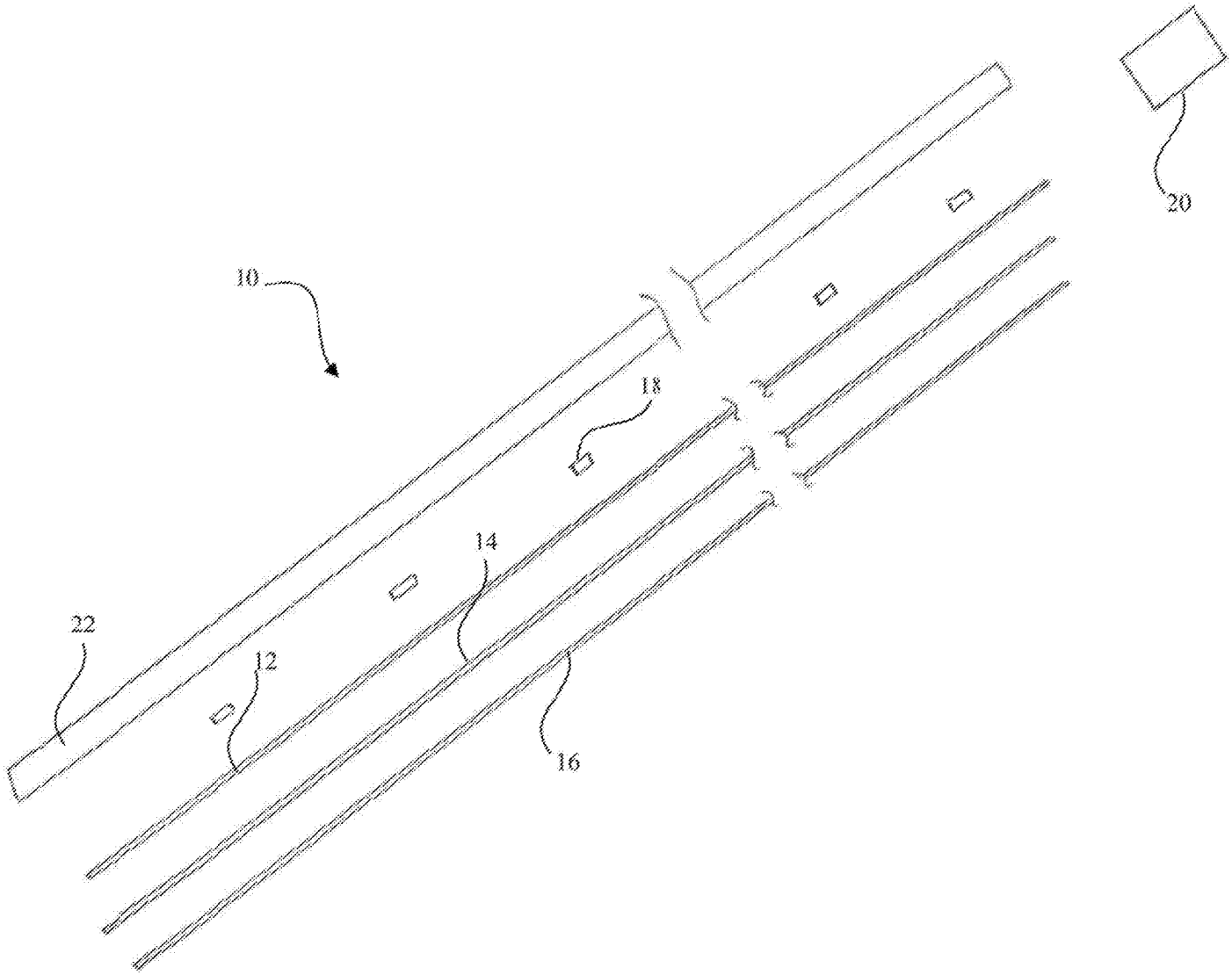
FIG. 2 is an exploded perspective view of the lighting system shown in FIG. 1.
Figure 3:
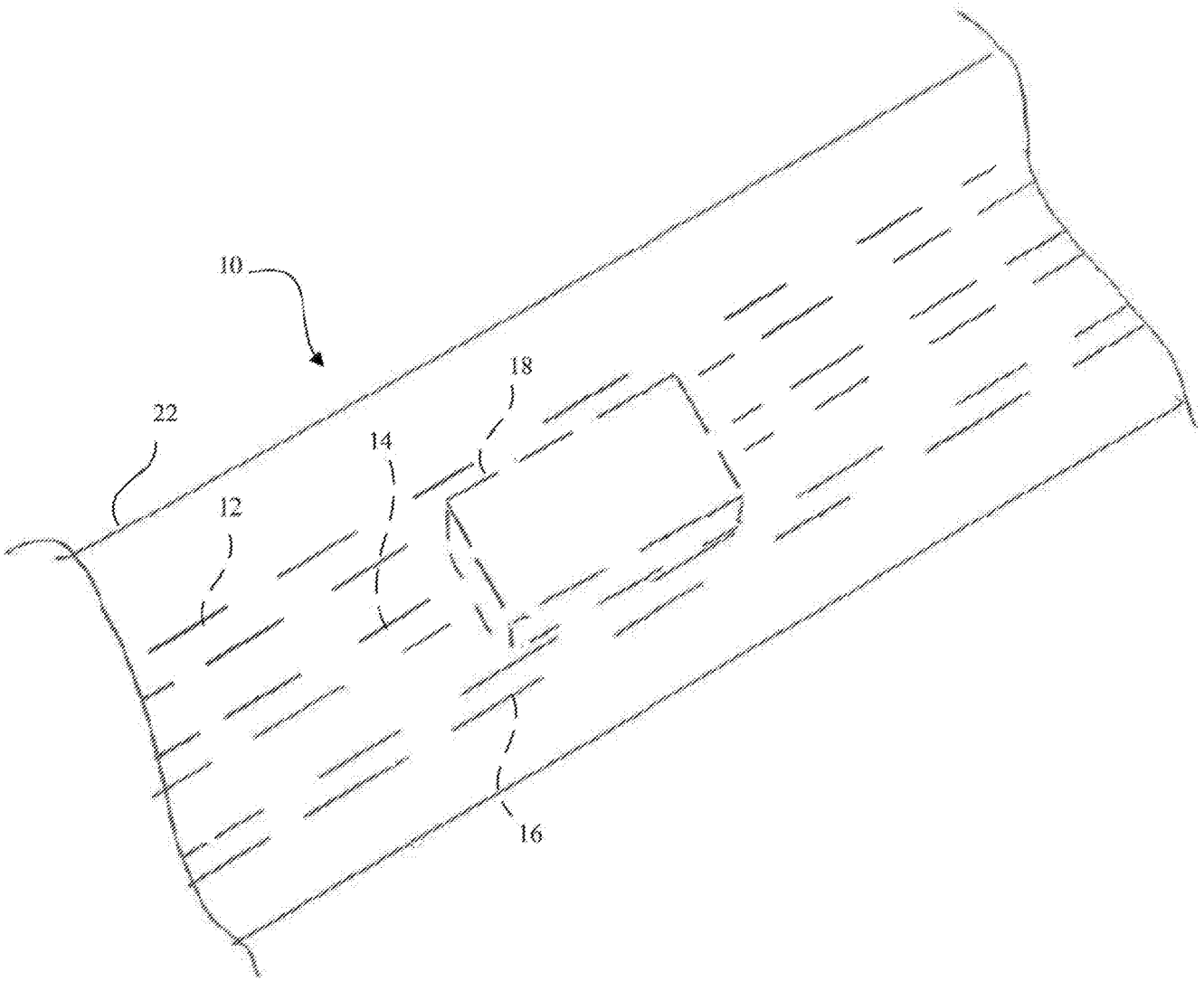
FIG. 3 is a close-up view of a portion of the lighting system shown in FIG. 1.

In one example, the first, second and third wires 12, 14, 16 are positioned side-by-side, such as extending in parallel with each other or being twisted together as a twisted bundle rather than each individual wire be being arranged concentrically (e.g., one inside the other) with each other. The exploded view of FIG. 2 illustrates the separate wires 12, 14, 16 as separate wires. In other embodiments, the wires may be preassembled as a wire bundle as described above. FIG. 3 is a close-up view of a portion of the LED lighting system 10 shown in FIG. 1. FIG. 3 illustrates the wires 12, 14, 16 positioned separately or at least arranged side-by-side within the insulated layer 22. The LED 18 may be arranged such that it can be electrically connected to two or more of the wires 12, 14, 16.

Figure 4:
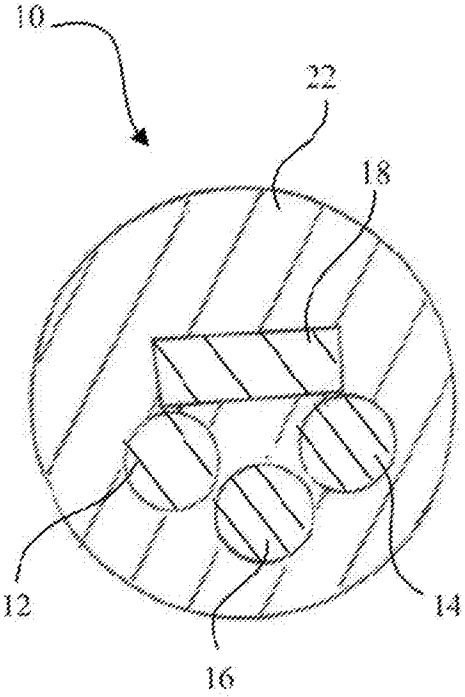
FIG. 4 is a cross-sectional view of the lighting system shown in FIG. 1 taken along cross-section indicators 4-4 showing a first embodiment.

FIG. 4 illustrates one embodiment for the insulated layer 22 in which the layer 22 completely encapsulates the wires 12, 14, 16 in the LEDs 18. The embodiment of FIG. 4 may be created using an extrusion process. The material of insulated layer 22 may be a polymer material. The polymer material may possess insulative properties. The insulated layer 22 may comprise materials that are flexible but also being durable, wear resistant and protective of the enclosed wires 12, 14, 16 and LEDs 18. Some example materials include flexible PVC, SEBS, Alcryn, TPV, Urethane, Copolyester, and TPA.

Figure 5:
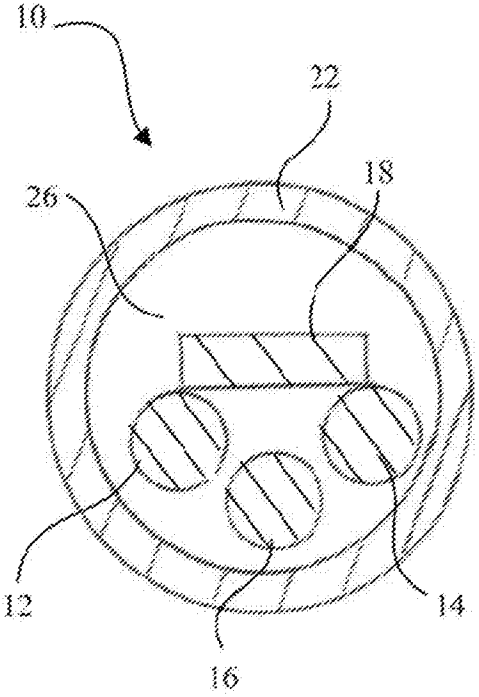
FIG. 5 is a cross-sectional view of the lighting system shown in FIG. 1 taken along cross-section indicators 5-5 showing a second embodiment.

FIG. 5 shows another example insulative layer 22 that defines a cavity 26 within which the wires 12, 14, 16 and LEDs 18 are enclosed. The insulated layer 22 may be provided as a sheath or tube that is pre-formed. The sheath or tube may be slid over the wires 12, 14, 16 and LEDs 18. In some embodiments, the insulated layer 22 may comprise shrink or heat shrink material that shrinks regularly inward in the presence of heat.

Figure 6:
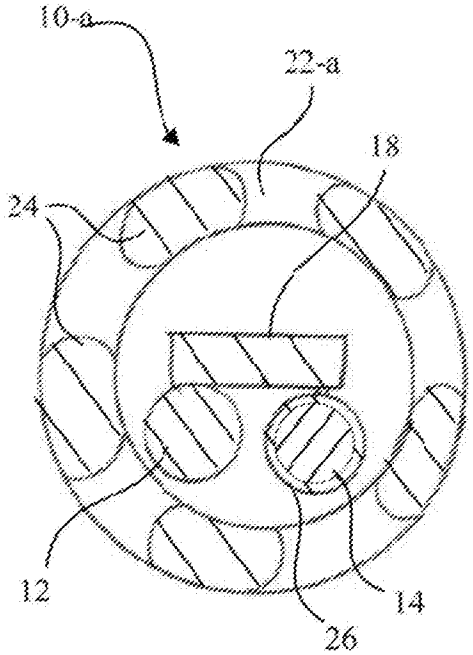
FIG. 6 is a cross-sectional view of another lighting system in accordance with the present disclosure.
Figure 7:
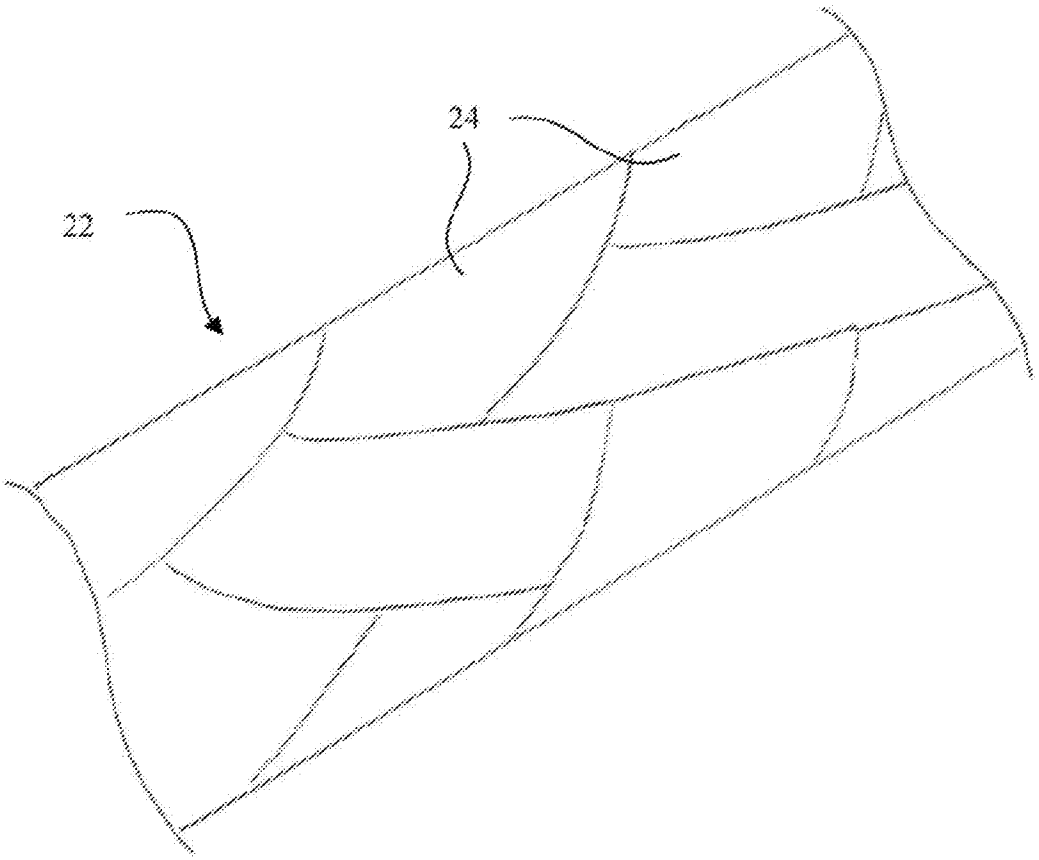
FIG. 7 is a perspective view of a portion of a lighting system having a braided exterior layer.

FIG. 6 illustrates a LED lighting system 10-A having an insulated layer 22-A comprised of a plurality of filaments 24 that are braided together. FIG. 7 is a perspective view showing the insulated layer 22 at its outer surface. The filaments 24 may be braided together to provide a protective or insulated layer around the wires 12, 14, 16 and LEDs 18. The filaments 24 may comprise polymer materials. The filaments may be braided using, for example, a maypole style weaving machine. In some examples, such weaving machines may spin bobbins of filaments around the exterior of the wires 12, 14, 16 and LEDs 18. In some embodiments, portions of the LEDs 18 may be exposed along the exterior of the LED lighting system 10-A. The number of filaments may vary, but at least in some embodiments are provided in pairs or at least in even numbers of filaments. The filaments may comprise any of a variety of different materials, such as fabric, polymers, composites, fiberglass, elastomeric (e.g., rubber), or the like. In at least some embodiments, the filaments comprise a transparent or at least translucent material that permits transmission of light from the LED to an outside of the LED lighting system.

Any of the materials used for the insulated layer 22 described herein may comprise a transparent or translucent material. In other embodiments, portions of the insulated layer 22 (e.g., adjacent to or surrounding the LEDs 18) may comprise a transparent or translucent material, whereas other portions of the insulated layer may comprise non-transparent or non-translucent materials that prohibit or significant limit the transmission of light therethrough. The material of insulated layer 22 may also provide an insulative layer between respective wires 12, 14, 16. The insulated layer 22 may comprise materials that provide a constricting force radially inward upon the wires 12, 14, 16 and LED 18 to constrain or assist in holding together those components of the LED lighting system 10.

The connector 20 may comprise, for example, a universal serial bus (USB) connector or plug. The USB plug may provide a relatively low voltage supply of power to the LEDs 18. A low voltage power may include a 5V DC power. The use of LEDs, which consume relatively small amounts of energy, and a USB plug, may permit operation of the LED lighting system 10 in relatively low power environments such as when backpacking, camping, mountaineering or other environments where power is only available via, for example, batteries, solar panels, wind, or water-based power. Any other types of connectors are possible for the connector 20 including, for example, a traditional 12V AC (alternating current) two or three prong plug, a direct connection to a battery, male or female style power transmitting plugs, or direct connect and solder to a power source, circuit or printed circuit board, or an AC/DC adapter.

As discussed above, any of the wires 12, 14, 16 may comprise an insulative coating, such as the coating 26 shown for wire 14 in FIG. 6. The coating 26 may comprise any insulating material that inhibits shorting between wires 12, 14, 16 and the LED's 18. An example for wires 12, 14, 16 is a stranded copper Litz wire. Litz wire may include several strands of enameled magnet wire that are bunched or stranded together. Litz wire may have a greater mechanical flexibility than a single wire with the same cross-section. Litz wire may be stranded wire in which strands are normally insulated from each other with a varnish insulation. The number of strands in a given Litz wire can be different from a few strands to 100 or more strands.

Figure 8:
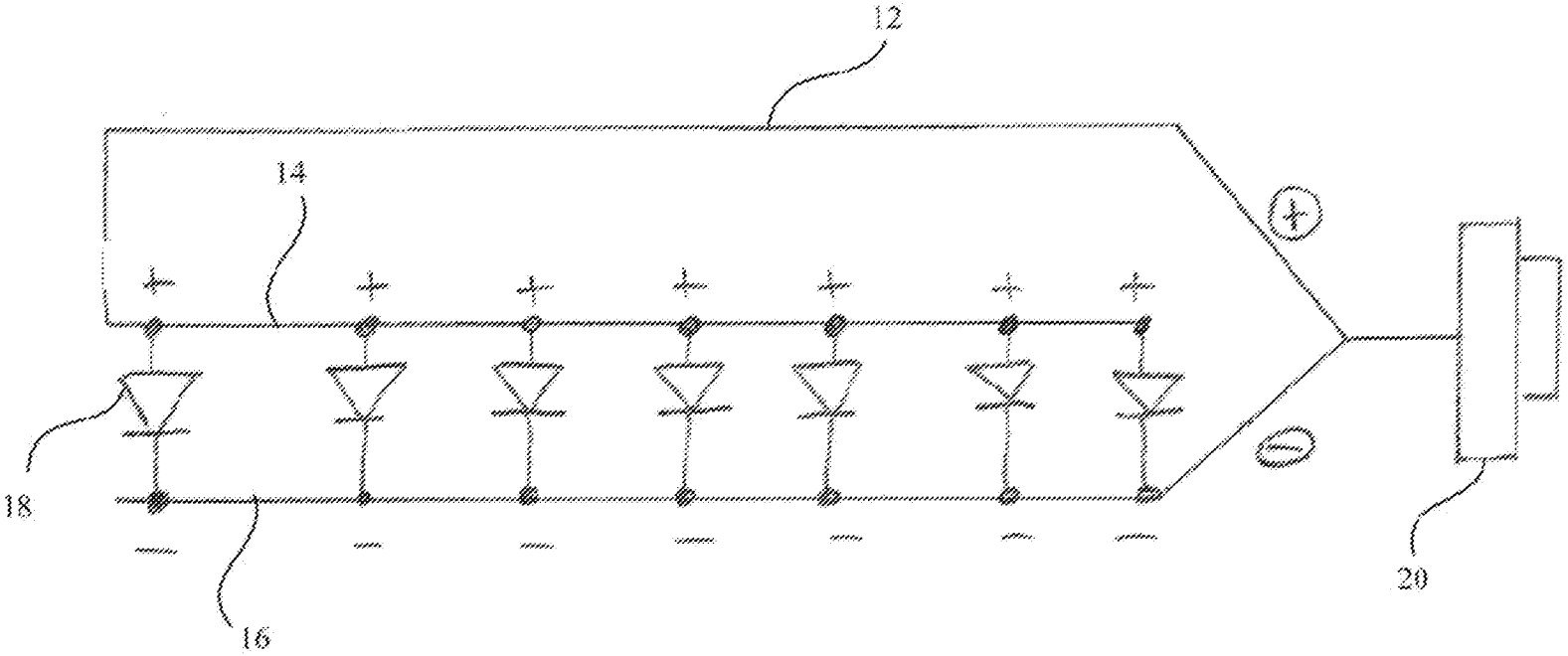
FIG. 8 is a circuit diagram for a lighting system in accordance with the present disclosure.

Referring to FIG. 8, a circuit diagram is shown to schematically represent the features of LED lighting system 10. The LED lighting system 10 may be connected in electronic communication with a power source via the connector 20. The power source may include a battery power source. The battery power source may, in some embodiments, be integrated into the LED lighting system 10 and may bypass the connector 20. In one embodiment, the battery power source is a mobile, rechargeable battery pack that is rechargeable, a cell phone, or a mobile powered generated unit, such as a solar panel.

The circuit diagram of FIG. 8 also includes wires 12, 14, 16 and LEDs 18. The wires 12, 14 may be a continuous wire that extends from connector 20 to an opposite end of the LED lighting system and back toward the connector 20 (but potentially not into electrical connection with the connector 20. The separate wire 16 extends from the connector 20 to each of the LEDs 18.

Figure 9:
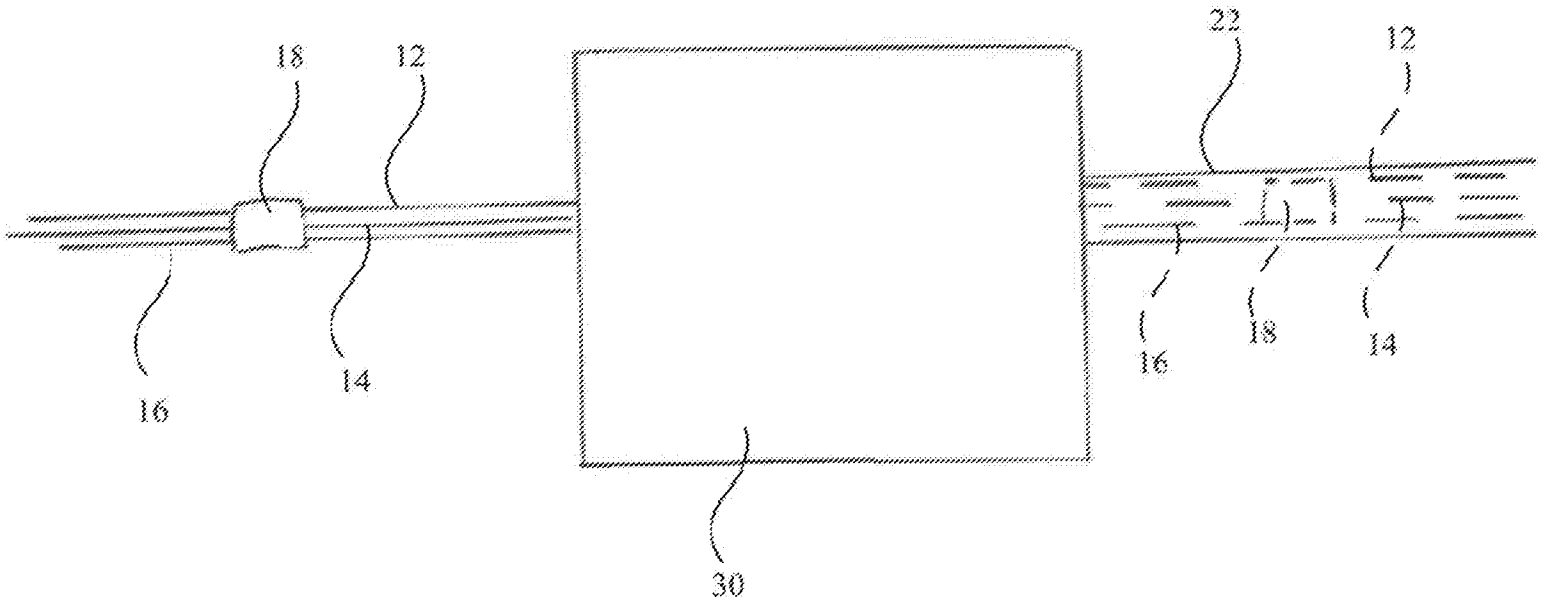
FIG. 9 shows an example system of forming an insulted layer for a lighting system in accordance with the present disclosure.

One method of forming the LED lighting systems disclosed herein includes use of an applicator 30 as shown in FIG. 9. The applicator 30 may be any of a variety of different devices used to apply the insulated layer 22 to the wires 12, 14, 16 and/or LEDs 18. In one embodiment, the applicator 30 is an extrusion device that extrudes the insulated layer 20 onto the wires 12, 14, 16 and LEDs 18 to create the embodiment of FIG. 4. In another example, the applicator 30 is a weaving machine that creates the braided insulated layer 22-A shown in FIG. 6. In yet further embodiments, the applicator 30 is a molding machine or apparatus that molds the insulated layer 20 into the exterior of the wires, 12, 14, 16 and LEDs 18. In molding processes, it may be advantageous to use different materials at different locations along the length of the LED lighting system 10 to provide the strength and durability properties along some portions, light transmissivity at other portions (e.g., in alignment with the LEDs 18) or different types of materials with different properties as desired.

Figure 10:
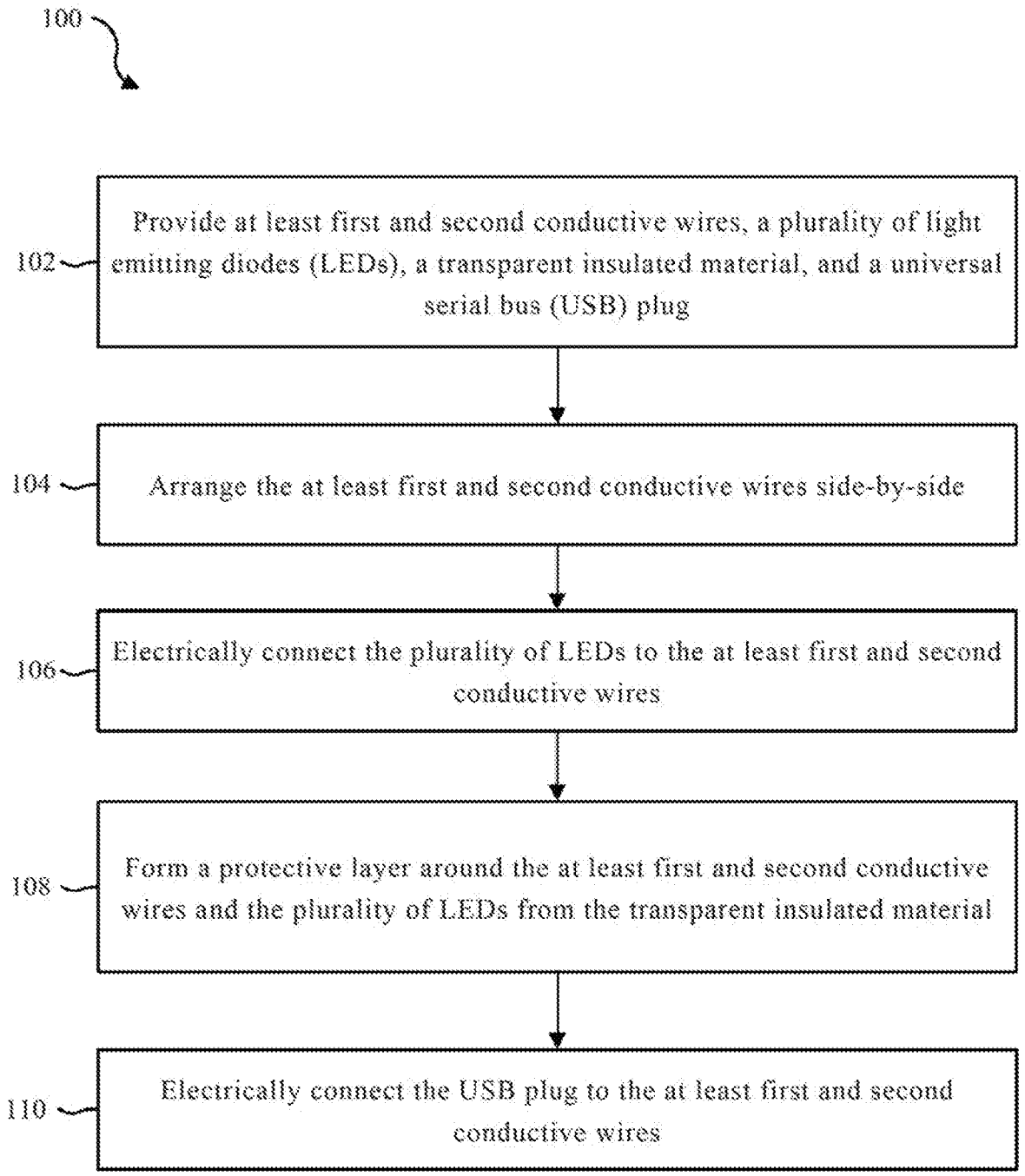
FIG. 10 is a flow diagram showing steps of an example method in accordance with the present disclosure.

FIG. 10 illustrates steps of an example method 100. The method 100 may be a method of manufacturing an LED lighting system in accordance with some aspects of the present disclosure. The method 100 may include, at block 102, the step of providing at least first and second conductive wires, a plurality of light emitting diodes, a transparent insulating material, and a universal serial bus plug. At block 104, the method includes arranging the at least first and second conductive wires side by side. Block 106 includes electrically connecting the plurality of LEDs to the at least first and second conductive wires. At block 108, the method 100 includes forming a protective layer around the at least first and second conductive wires and the plurality of LEDs from a transparent insulated material. Block 110 includes electrically connecting the USB plug to the at least first and second conductive wires.

The method 100 may also include arranging an insulative material between the at least first and second conductive wires. The insulative material may be provided by the protective layer when it is formed. The method 100 may include providing the transparent insulative material using a plurality of strands of plastic material, and forming the protective layer may include the braiding the plurality of strands of plastic material. Forming the protective layer may include extruding the transparent insulative material around the at least first and second conductive wires and a plurality of LEDs from the transparent insulative material. Connecting the plurality of LEDs and the USB plug to the first and second conductive wires may include soldering the plurality of LEDs and USB plug to each of the at least first and second conductive wires. Forming the protective layer may include encapsulating the first and second conductive wires and the plurality of LEDs with the transparent insulative material.

Other methods and of course the present disclosure may include arranging a plurality of conductive wires side by side, mounting LEDs at spaced apart locations or in the length of the conductive wires, and forming a protective layer around the wires at least along a portion of the length of the conductive wires. The protective layer may include, for example, a plurality of braided strands. The method may also include connecting one or more connectors to the plurality of conductive wires. The connector may include, for example, a USB connector. A different material may be used to cover and/or protect the LEDs as a portion of the conductive wires extending between adjacent LEDs.

Various inventions have been described herein with reference to certain specific embodiments and examples. However, they will be recognized by those skilled in the art that many variations are possible without departing from the scope and spirit of the inventions disclosed herein, in that those inventions set forth in the claims below are intended to cover all variations and modifications of the inventions disclosed without departing from the spirit of the inventions. The terms "including:" and "having" come as used in the specification and claims shall have the same meaning as the term "comprising."

What is claimed is:

1. A lighting system, comprising:

first, second and third conductive wires arranged side-by-side;

a universal serial bus (USB) plug electrically connected to the second and third conductive wires;

a plurality of light emitting diodes (LEDs) mounted and electrically connected to the first and second conductive wires, the plurality of LEDs arranged in series with a first of the plurality of LEDs being positioned closest to the plug and a last of the plurality of LEDs being positioned furthest from the plug, the first conductive wire extending from the first to the last of the plurality of LEDs, and the third conductive wire extending from the last of the plurality of LEDs to the plug, wherein the third wire bypasses all but the last of the plurality of LEDs.

2. The lighting system of claim 1, further comprising a transparent insulated layer extending around and encapsulating the first, second and third conductive wires and the plurality of LEDs.

3. The lighting system of claim 1, further comprising a braided layer positioned around the plurality of conductive wires, the braided layer comprising a plurality of strands of material braided together, the braided layer providing at least one of an insulating property, a wire containment property, and a wear resistant property for the lighting system.

4. The lighting system of claim 1, wherein the USB plug is configured to be connected to a low voltage power source.

5. The lighting system of claim 1, wherein the first wire is indirectly connected to the plug via the third wire.

6. A low voltage lighting system, comprising:

a plug configured to be coupled to a power source;

a first conductive wire configured to carry a positive charge;

a second conductive wire connected to the plug and configured to carry a negative charge;

a third conductive wire connected to the plug;

a plurality of light emitting diodes (LEDs) mounted to the first and second conductive wires, the plurality of LEDs arranged in series with a first of the plurality of LEDs being positioned closest to the plug and a last of the plurality of LEDs being positioned furthest from the plug, the first and second conductive wires extending from the first to the last of the plurality of LEDs, and the third conductive wire extending from the last of the plurality of LEDs to the plug and bypassing the remaining LEDs.

7. The lighting system of claim 6, further comprising a transparent insulated layer extending around and encapsulating the first, second and third conductive wires and the plurality of LEDs.

8. The lighting system of claim 6, wherein the lighting system has a length of at least 10 ft.

9. The lighting system of claim 6, wherein the plug is a USB plug and the power source is a low voltage power source.

10. The lighting system of claim 6, wherein the transparent insulated layer comprises an ultraviolet (UV) light resistant material.

11. The lighting system of claim 6, wherein the third conductive wire is contiguous with the first conductive wire.

12. The lighting system of claim 6, wherein the first wire is indirectly connected to the plug via the third wire.

13. A method of manufacturing a low voltage lighting system, comprising:

providing first, second and third conductive wires, a plurality of light emitting diodes (LEDs), a transparent insulated material, and a plug;

arranging the first, second and third conductive wires side-by-side;

electrically connecting the USB plug to the second and third conductive wires;

electrically connecting the plurality of LEDs to the first and second conductive wires, the plurality of LEDs arranged in series with a first of the plurality of LEDs being positioned closest to the plug and a last of the plurality of LEDs being positioned furthest from the plug, the first and second conductive wires extending from the first to the last of the plurality of LEDs, and the third conductive wire extending from the last of the plurality of LEDs to the plug, wherein the third wire bypasses all but the last of the plurality of LEDs, and the first wire is indirectly connected to the plug via the third wire.

14. The method of claim 13, further comprising arranging an insulative material between the first, second and third conductive wires.

15. The method of claim 13, further comprising forming a protective layer around the first, second and third conductive wires and the plurality of LEDs from the transparent insulated material, the transparent insulated material includes a plurality of strands of plastic material, and forming the protective layer includes braiding the plurality of strands of plastic material.

16. The method of claim 13, wherein forming a protective layer around the first, second and third conductive wires and the plurality of LEDs from the transparent insulated material, and forming the protective layer includes extruding the transparent insulated material around the at least first and second conductive wires and the plurality of LEDs from the transparent insulated material.

17. The method of claim 13, wherein electrically connecting the plurality of LEDs to the first and second conductive wires includes soldering the plurality of LEDs to each of the first and second conductive wires.

18. The method of claim 13, wherein forming a protective layer around the first, second and third conductive wires and the plurality of LEDs from the transparent insulated material, and forming the protective layer includes encapsulates the first, second and third conductive wires and the plurality of LEDs with the transparent insulated material.

* * * * *